United States Patent [19]

Hine

[11] Patent Number: 4,814,263

[45] Date of Patent: Mar. 21, 1989

[54] DIRECT-POSITIVE SILVER HALIDE EMULSION

[75] Inventor: Philip Hine, St. Paul, Minn.

[73] Assignee: Minnesota Mining and Manufacturing Company, St. Paul, Minn.

[21] Appl. No.: 76,007

[22] Filed: Jul. 21, 1987

[51] Int. Cl.[4] ..... G03C 1/485

[52] U.S. Cl. ..... 430/567; 430/568; 430/597; 430/412

[58] Field of Search ..... 430/597, 412, 567, 568

[56] References Cited

U.S. PATENT DOCUMENTS

| | | | |
|---|---|---|---|
| 3,367,778 | 2/1968 | Berriman | 430/597 |
| 3,661,592 | 5/1972 | Philippaerts et al. | 96/94 |
| 3,847,617 | 11/1974 | Philippaerts et al. | 96/94 R |
| 3,869,290 | 3/1975 | Philippaerts et al. | 96/76 |
| 4,008,089 | 2/1977 | Pattyn et al. | 96/108 |
| 4,082,554 | 4/1978 | Pattyn et al. | 96/101 |
| 4,495,274 | 1/1985 | Yoshida | 430/523 |
| 4,581,327 | 4/1986 | Habu et al. | 430/567 |

*Primary Examiner*—Won H. Louie

*Attorney, Agent, or Firm*—Donald M. Sell; Walter N. Kirn; Mark A. Litman

[57] ABSTRACT

A direct-positive silver halide emulsion comprising fine grain reduction and gold surface fogged silver halide grains containing an electron-trapping effective amount of at least one Group VIII metal dopant, at least 75% by weight of all silver halide grains in said emulsion being silver halide grains wherein at least 80 mole percent of the halide within said grains is chloride.

21 Claims, No Drawings

DIRECT-POSITIVE SILVER HALIDE EMULSION

BACKGROUND OF THE INVENTION

1. Field of the Invention

The present invention relates to direct-positive silver halide photographic emulsions comprising high chloride content silver halide grains containing Group VIII metal dopant and which are both reduction and gold surface fogged.

2. Background of the Art

It is known that direct-positive images can be obtained with certain types of photographic silver halide emulsions without previously forming a negative silver image. As described in British patent specification No. 723,019, one photographic emulsion of this type is a photographic emulsion comprising one or more electron-trapping compounds and silver halide grains which are fogged with a combination of a reducing agent and a gold compound or a compound of a metal more electropositive than silver e.g. palladium or platinum.

According to U.S. Pat. Nos. 3,501,305 and 3,501,306, improved photographic direct-positive emulsions of this type are obtained with mono-dispersed direct-positive emulsions, i.e. emulsions the grains of which have substantially the same diameter, more particularly at least 95% by weight or number of the silver halide grains are of a size which is within about 40% of the mean grain size, and with regular grain direct-positive emulsions i.e. emulsions of which at least 80% by weight of the grains have a regular crystal shape. These emulsions are preferably emulsions obtained by combining a low level of gold fogging with a low level of reduction fogging.

Although according to the above U.S. Patents the mean grain diameter of the direct-positive silver halide emulsions may be comprised between about 10 nm and about 2000 nm so that Lippmann emulsions, which have an average grain diameter of less than 100 nm and preferably less than 80 nm, are embraced, the teachings of these patents has not been found to be sufficient to provide direct-positive silver halide Lippmann emulsions yielding upon exposure and development direct-positive images of sufficient overall contrast, sufficient contrast in the highlight areas and sufficient maximum density.

Lippmann emulsions are of particular importance for the preparation of photographic plates or films with high resolution, for use in microphotography and astrophotography, for recording nucleo-physical phenomena, for the preparation of masks in the production of microelectric integrated circuits, for use in holography for high-density data storage, etc.

U.S. Pat. No. 4,082,554 teaches that improved direct-positive images as regards, overall contrast, contrast in the high-light areas and maximum density are obtained upon exposure and development of a direct-positive silver halide Lippmann emulsion comprising reduction and gold fogged silver halide grains of an average grain diameter of less than 100 nm and at least one electron accepting compound when the silver halide grains are fogged with from about 0.07 to about 0.5 milliequivalent per mole of silver halide of a reduction fogging agent and with from about 0.01 to about a 0.1 millimole per mole of silver halide of a gold fogging agent and the silver halide emulsion layer comprises per mole of silver halide more than 2 g and at most about 10 g of electron-accepting compounds.

U.S. Pat. No. 3,945,832 describes a fogged direct positive silver halide emulsion spectrally sensitized with dyes of specified formulae. An emulsion is shown in the Examples which has 80% Cl in the silver halide. No dopants are specifically described in the claims, but are mentioned in the text. No size range is indicated in the Example for the silver halide grains.

BRIEF DESCRIPTION OF THE INVENTION

In recent years, in the field there has been a trend toward development of low speed direct positive (duplicating) silver halide films which can be handled under bright yellow lighting conditions, and even lower speed films which can be handled in ordinary room lighting. Typically we are referring to light sensitive materials that can be used at a light level of 200 lux for several minutes without a loss in Dmax. In order to maximize the room safety of such films it is necessary that their spectral sensitivity is confined mainly in the U.V. region of radiation, and that the sensitivity in the visible region be minimized. In order to achieve this, predominantly silver chloride emulsions are preferred over predominantly silver bromide emulsions because of their shorter spectral cut-off in the visible region.

In addition to a high chloride ratio it is a distinct advantage to utilize grains of less than 100 nm average diameter. These ultrafine grains are of particular importance for the preparation of photographic plates or films with high resolution and because of the highly efficient silver utilization.

Thus by means of this invention, direct-positive photographic silver halide elements having improved room-light handleability and good image density and resolution are provided by using fine grain, high chloride content silver halide emulsions which are surface reductant and gold fogged and contain an electron trapping effective amount of a Group VIII metal dopant. The surface of the fogged grains have a very low level of electron-accepting compounds or are preferably substantially free of electron-accepting compounds.

DETAILED DESCRIPTION OF THE INVENTION

It is desirable to provide direct-positive silver halide element which are safelight or even room light handleable, without sacrificing important sensitometric characteristics of the element. These properties are provided in the element by using a fine grain, direct-positive, high chloride content, surface reduction and surface gold fogged, silver halide grain having an electron trapping effective amount of a Group VIII metal dopant. The grains should also have little electron-accepting compound on the surface of the grain and preferably is substantially free of electron-accepting compounds.

By the term fine grain emulsion is meant a silver halide emulsion in which the average particle diameter is 100 nm or less. Preferably, the average silver halide particle diameter is 80 nm or less. These grains are well known in the art and may be provided by known synthetic procedures.

By the term high chloride content, it is meant that at least eighty molar percent of the halide within the grain is chloride. It is a minimum requirement in the practice of the present invention that at least 75% by weight of all silver halide grains in the emulsion are high chloride content grains. It is preferred that at least 85% of the grains in the emulsion are high chloride, more preferred that at least 95% are high chloride, and most preferred that about 100% by weight of all silver halide grains are high chloride content grains. It is preferred that the high chloride grains comprise between 80 and 98% chloride, more preferably between 80 and 92%, and most preferably between 80 and 90% chloride.

The direct-positive silver halide emulsions are reduction- and gold-fogged which means that they are fogged with a combination of a reducing fogging agent and a gold fogging agent.

The reducing fogging agent is used in an amount from about 0.07 to about 0.5 milliequivalents, preferably from about 0.1 to about 0.3 milliequivalents per mole of silver halide. A preferred reducing fogging agent is thiourea dioxide, which is preferably employed in the range of about 4 mg to about 30 mg, most preferably from about 5 mg to about 15 mg per mole of silver halide. Other suitable reducing agents are tin (II) salts which include tin chloride, tin complexes, and tin chelates of the (poly)amino(poly)carboxylic acid types as described in British Patent Specification No. 1,209,050, formaldehyde, hydrazine, hydroxylamine, phosphonium salts such as tetra(hydroxymethyl) phosphonium chloride, polyamines, e.g., diethylene triamine, bix(p-aminoethyl)sulfide and its water-soluble salts, etc.

The gold fogging agent is used in an amount from about 0.01 to about 0.1 millimole preferably from about 0.02 to about 0.05 millimole per mole of silver halide. Gold fogging may occur by means of any gold compound known for use in fogging photographic silver halide grains. Specific examples of gold fogging agents are potassium tetrachloroaurate, auric trichloride, potassium aurithiocyanate, etc. It is also possible to employ a mixture of water-soluble gold compound, e.g., auric trichloride and thiocyanates forming complexes with gold and having a solvent action on the silver halide grains, e.g., alkali metal and ammonium thiocyanates. A preferred gold fogging agent is potassium tetrachloroaurate which is generally used at concentrations from about 5 mg to about 50 mg, preferably from about 10 mg to about 30 mg per mole of silver halide.

Fogging of the silver halide grains may be effected by using the reducing agent initially and subsequently using the gold compound. However, the reverse order of agents can be used or the reduction- and gold-fogging agents can be used simultaneously.

The pH, pAg and temperature conditions during fogging of the silver halide grains are subject to wide variation. Fogging is preferably effected at neutral or high pH values, e.g, a pH value of at least 6.5 and at a pAg value below 9, preferably below 8.35. The temperature is generally comprised between about 40° C. and about 100° C., preferably from about 50° C. to about 70° C.

U.S. Pat. No. 4,082,554 avoids the specific inclusion of any possible high chloride content emulsions in their suggested silver salts. Only bromochloride emulsions and bromochloroiodide emulsions are suggested with any allowable chloride content. Silver halide grains consisting of silver bromide are preferred.

In initial investigations of the use of high chloride content direct-positive silver halide emulsions it was found that inefficient reversal resulted from the high chloride content. This displayed itself both as high background image (Dmin) and re-reversal. Re-reversal is a phenomenon in which the direct-positive emulsion becomes similar to a negative acting emulsion after an excessive exposure to radiation (e.g., light to which the emulsion is sensitive).

This re-reversal phenomenon can be defined as the negative speed which continues to build up on extended exposures beyond that of the main reversal exposure. It is imperative that the re-reversal is kept to a minimum in order that multiple exposures in Dmin areas do not cause a Dmin buildup again. A rule of thumb in the industry is that an exposure of ten (10) times the original main exposure should not cause an increase in Dmin. The levels of Dmin caused at least in part by re-reversal were unacceptably high in initial attempts to provide high chloride content direct-positive emulsions.

It has been found in the practice of the present invention that a number of parameters are important in being able to provide both safelight (or roomlight) handleable emulsions and yet provide emulsions with acceptable Dmin. The initial parameters include the use of at least 75% by weight of all grains in the emulsion as high chloride (at least 80 molar percent of the halide) grains, surface reductions and surface reduction and surface gold fogging, and an internal electron-trapping effective amount of a Group VIII metal dopant. To provide an optimum system, the emulsion should contain less than 1.5 g of electron accepting compounds per mole of silver halide on the surface of the grains or in the binder for the grains. It is preferred that the grains be substantially free of such electron accepting compounds; that is, that there be less than 0.15 gram of such compounds per mole of silver halide on the surface of the silver halide grains. Most preferably, the emulsion is free of electron-accepting compounds which could adhere to the surface of the silver halide grains.

It is also preferred in the practice of the present invention to eliminate organic grain growth restraining compounds during the formation and growth of the silver halide grains. These compounds tend to induce negative sensitivity in the grains by inhibiting the fogging action. Some grain growth inhibitors, such as sulfur containing heterocyclic compounds, decompose during the chemical fogging treatment and form negative sensitivity sites. It is usually possible to analyze for the present or absence of these grain growth inhibitors by accepted analytical techniques.

To summarize, two key complicating effects have limited the advancement for subdued daylight handleable direct positive films:

1. Increased chloride in the emulsion grains is beneficial for improved safelight tolerance but at increased chloride it is more difficult to get efficient reversal and consequently high Dmin and re-reversal become severe problems.

2. It is difficult to grow small grains less than 100 nm using high chloride ratio while minimizing the type and amount of growth restrainers used.

The object of this invention is to grow predominantly silver chloride grains of $<100$ nm mean diameter without the need of strongly adsorbed grain growth restrainers.

It is, further, the object of this invention to utilize inorganic internal electron accepting compounds added during grain formation as the primary electron trapping system. Such compounds are the salts and complex salts of the Group VIII members of the periodic table which eliminate or vastly reduce the amounts of surface electron accepting compounds needed which could degrade the safelight tolerance by extending the spectral sensitivity more into the visible region. Such dopants of Group VIII metals are used in electron-trapping effective amounts which usually are between $10^{-4}$, and $10^{-3}$ mole/mole Ag. Preferred metals are rhodium, ruthenium, iridium and combinations thereof.

It is further the object of this invention to provide a low sensitivity direct positive emulsion which has high Dmax, low Dmin, high contrast and little or no re-reversal over an extended range of exposure.

It has now been found that improved direct-positive images as regards, overall contrast, toe contrast, maximum density, minimum density, and re-reversal are obtained upon exposure and development of a direct-positive silver halide Lippmann emulsion comprising surface reduction and gold fogged silver halide grains of an average grain diameter of less than 100 nm which are substantially silver chloride and wherein the grains contain a sufficient amount of a Group VIII metal to trap electrons and the surface is substantially free from electron accepting compounds.

We have found that for halide ratios less than 90% chloride we can control the precipitation conditions such that we can reproducibly make fine grains less than 100 nm. However, as the chloride % becomes greater than 90% we must resort to a core-shell growth technique.

After fogging it is not necessary, and in fact it is undesirable, to add any large amount of surface electron accepting compounds. However, in certain cases residual negative sensitivity can be further suppressed by addition of small quantities ≦(1.5 g/mole) of the common non-spectrally sensitizing compounds such as pinacryptol yellow or 6-nitro-benzimidazole. The levels of such compounds must be kept low to preserve room light safety and to preserve Dmax and contrast.

The electron-accepting compounds preferably have non-spectrally sensitizing properties although it is also possible to use electron-accepting compounds that do spectrally sensitize the emulsion or to use combinations of both types.

Further, the direct-positive-type silver halide photographic light-sensitive material of the present invention may also contain a dye capable of absorbing visible rays to be cut so that the light-sensitive material can be handled in a relatively bright place where ultraviolet rays-free fluorescent lamp light is used. The dye includes, for example, oxonol dyes, azo dyes, substituted malononitriles, benzylidene dyes, and the like.

The direct-positive-type silver halide photographic light-sensitive material of the present invention may also contain generally used various other photographic additives which include stabilizers such as, e.g., triazoles, azaindenes, quaternary benzothiozolium compounds, mercapto compounds, water-soluble inorganic salts of cadmium, cobalt, nickel, manganese, thallium and the like; hardeners such as aldehydes, including formalin, glyoxal, mucochlroic acid, etc., s-triazines, epoxys, aziridines, vinyl-sulfonic acid and the like; coating aids such as, e.g., saponin, sodium polyalkylenesulfonate, laury- or oleyl-monoether of polyethylene glycol, amylated alkylurethane, fluorine-containing compounds, and the like; and sensitizers such as, e.g., polyalkylene oxide and the derivatives thereof. Besides, the light-sensitive material may further contain color couplers and, if necessary, a brightening agent, ultraviolet absorbing agent, preservative, matting agent, antistatic agent, and the like.

As the binder for the silver halide photographic light-sensitive material of the present invention, for example, gelatin is used, and in addition to this, there may also be together gelatin derivatives, such a natural substance as albumin, agar-agar, gum arabic, alginic acid, or the like, polyvinyl alcohol, polyvinyl acrylate, polyvinyl pyrrolidone, cellulose ethers, partially hydrolyzed cellulose acetate, hydrophilic polymers such as poly(N-hydroxyl-alkyl)B-cyanine derivative obtained by the graft-polymerization of ethylene oxide, or the like. Further, as the binder for the silver halide emulsion, dispersion-polymerized vinyl compounds may be used as well; for example, a polymer latex obtained by the emulsion polymerization in the presence of an active agent of an unsaturated ethylene-type monomer, or a polymer latex obtained by the graft-polymerization with use of a ceric salt of a hydroxyl group having macromolecular compound and an unsaturated ethylene-type monomer. The use of these latexes is desirable for the improvement of the physical characteristics of the emulsion layer.

In addition, there may be allowed to incorporate into the emulsion layer a developer in the protected form, such a higher fatty acid as liquid paraffin, such a higher unsaturated fatty acid as stearylacetoglyceride, etc., in the protected form for the purpose of improving the physical characteristics of the emulsion layer, and further, according to purposes, color couplers, stabilizer, ultraviolet absorbing agent, and the like, also in the protected form.

For the support of the direct-positive-type silver halide photographic light-sensitive material of the present invention, any appropriate arbitrary photographic support material may be used which includes, e.g., glass, wood, metal, film, paper, or the like, the film including, e.g., cellulose acetate, cellulose acetate-butyrate, cellulose nitrate, polyester, polyamine, polystyrene, and the like, the paper including, e.g., baryta-coated paper, polyolefin-coated paper such as polyethylene- or polypropylene-coated paper, if subjected to an electron-impact treatment such as corona-discharge treatment, may be useful for the improvement on the adhesion of an emulsion layer. The emulsion of the invention may be coated on one or both sides of the support.

In the direct-positive Lippmann emulsions of the present invention, various silver salts may be used as the light-sensitive salt, e.g., silver chloride, silver chlorobromide, silver chloroiodide, silver bromochloroiodide, but it is preferred to use silver halides predominantly consisting of silver chloride, e.g., silver chloride emulsions where at least 75% by weight of said silver halide grains are comprised of at least 80% chloride grains. Any iodide should be minimized as it extends the sensitivity more into the visible.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, e.g., albumim, zein, agar-agar, gun arabic, alginic acid, and derivatives thereof, e.g., salts, amides and esters, starch and derivatives thereof, cellulose derivatives, e.g., cellulose esters, partially hydrolyzed cellulose acetate, carboxymethyl cellulose, etc. or synthetic hydrophilic resins, for example polyvinyl alcohol, polyvinyl pyrrolidone, homo- and copolymers of acrylic and methacrylic acid or derivatives, e.g., esters, amides and nitriles, vinyl polymers, e.g, vinyl ethers and vinyl esters.

The direct-positive silver halide emulsions for use in accordance with the present invention may comprise additional additives known to be beneficial in photographic emulsions. They may comprise spectrally sensitizing dyes that are not electron-accepting such as, e.g., cyanines, merocyanines, complex (trinuclear) cyanines, complex (trinuclear) merocyanines, styryls, and hemicyanines, e.g., speed-increasing compounds, stabilizers, antistatic agents, coating aids, optical brightening agents, light-absorbing dyes, plasticizers and the like.

In the interest of high resolving power and acuteness, scattering and reflection of light within the photographic material should be avoided. For this purpose, light-absorbing dyes can be used in an antihalation layer coated on the back of a transparent support or between the support and emulsion layer. It is also possible to incorporate light-absorbing dyes within the silver halide emulsion layer. Classes and representatives examples of light-absorbing dyes for use in an antihalation layer or the emulsion layer can be found in British Patent Specification No. 1,298,335 and Belgian Pat. No. 699,375 as well as the patent literature referred to therein.

The silver halide emulsion layer and other hydrophilic colloid layers of a direct-positive photographic material employed in accordance with the present invention may be hardened by means of organic or inorganic hardeners commonly employed in photographic silver halide elements, e.g., the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The sensitivity and stability of the direct-positive silver halide emulsions can be improved by coating the emulsions on the support at reduced pH value, preferably a pH of about 5, and/or at increased pAg value, of +30 mV or less (silver against saturated calomel electrode) as described in British Patent Application No. 32889/72.

Development of the exposed direct-positive silver halide emulsions of the invention may occur in alkaline solutions containing conventional developing agents such as hydroquinones, catechols, aminophenols, 3-pyrazolidinones, ascorbic acid and derivatives, hydroxylamines, etc. or combinations of developing agents.

Development may occur by means of a combination of developing agents that have a superadditive action, e.g., hydroquinone together with N-methyl-p-aminophenol sulphate or other p-aminophenol derivatives and hydroquinone together with 1-phenyl-3-pyrazolidinone or other 3-pyrazolidinone derivatives.

The following examples illustrate that in order to obtain satisfactory direct-positive fine grain emulsions that have high chloride contents and that are suitable for direct-positive materials for use in daylight handling contact applications the emulsions should contain primarily interior electron traps and should be surface reduction and gold fogged and contain a minimum of exterior electron traps.

EXAMPLES

Example 1

Preparation of Emulsion Non-Layered Construction) 1 mole

Solution A
Water—833.3 g
Modified Gelatin—25 g
Poly(vinyl pyrollidone) (K-30)—6.33 g
KBr—0.167 ml (1N)
Solution B
Water—368 g
$AgNO_3$—170 g
Solution C
Water—361.3 g
KCl—62.65 g (0.84 mole)
KBr—19.04 g (0.16 mole)
$Na_3RhCl_6.12H20$—0.200 g Aqueous Solution B and aqueous Solution C were simultaneously added to and mixed, over a period of 25 minutes, by the double jet method with aqueous gelatin Solution A. The gelatin solution was kept constant at 30° C. The flow rate of Solution B was constant while the flow rate of Solution C varied such that the millivolt of the emulsion being formed was controlled at 120±2 mv as measured by a Br specific ion electrode and a saturated Ag/AgCl reference electrode of a double junction type.

Subsequently, the water-soluble salt was removed from the mixture by an ordinary aggregation method, and then gelatin and caustic were added to the desalted emulsion to thereby prepare a silver chlorobromide emulsion which contains 84% Cl and 16% Br and whose mean particle size is 0.09 micron.

This emulsion, after adding 90 mls per mole of silver halide of a millimolar solution of thiourea dioxide thereto, was ripened at 60° C. for 60 minutes, and then, after adding 15 mls per mole of silver halide of a millimolar solution of $NaAuCl_4$ thereto, was again ripened at 60° C. until the maximum characteristics were obtained, thereby fogging the emulsion.

To this fogged emulsion additional unactivated gelatin was added to obtain a suitable concentration for coating, 1 g/mole Ag of a substituted malononitrile filter dye was added to attain the desired speed and 1 g/mole silver of 6-nitrobenzimidazole was added to improve the contrast and formaldehyde was added as the hardening agent.

The mixture was applied to a subbed poly(ethylene terephthalate) film base with an appropriate topcoat to give a silver deposit of 2.3 g $Ag/m^2$ and a gelatin deposit of 2.4 $g/m^2$.

The coatings were then sensitometrically exposed using a 0–2 20 cm continuous grey scale glass wedge and a Theimer Violux® 1500 S Printing Light System exposure unit. The lamp was a TH 1507 Multispectrum, metal halide, 1500 watt which was housed 50 inches from the exposure plane. The sensitometric exposure was 200 units which is equivalent to about 18–20 seconds.

The exposed film was then processed in a commercially available PAKO 32 MQ rapid access processor with 3M RPD TM Rapid Access developer. The developer temperature was maintained at 100° F. and the time in the developer was 20 seconds.

Rapid access development chemistry usually comprises high sulfite content hydroquinone developer solutions which are aerially stable and are often capable of producing high contrast images. Metol or phenidone are usually included in the solution. Results of sensitometry and re-reversal are shown in Tables 1 and 2.

Example 2

Preparation of Core-Shell (layered grain construction)
1 mole

Solution A
Water—833.3 g
Modified Gelatin—25 g
Poly(vinyl pyrollidone) (K-30)—6.33 g
0.1N KBr—0.167 ml
Solution B
Water—368 g
$AgNO_3$—170 g
Solution C
Water—90.3 g
KCl—15.66 g (85%) 0.21 mole, 0.25 of total
KBr—4.76 g (16%) 0.04 mole
$Na_3RhCl_6.12H20$—0.05 g
Solution D
Water—253 g
KCl—54.8 g (98%) 0.735 mole, 0.75 of total
KBr—1.785 g (2%) 0.015 mole
$Na_3RhCl_6.12H20$—0.15 g
Final Cl/Br=94.5/5.5, Total Rh Salt=0.2 g/mole Aqueous Solution B and aqueous Solution C were simultaneously added and mixed, over a period of 6.5 minutes, by the double jet method with aqueous gelatin Solution A. The gelatin solution was kept constant at 30° C. The flow rate of Solution B was constant while the flow rate of Solution C varied such that the millivolt of the emulsion being formed was controlled at 120±2 mv as measured by a Br specific ion electrode and a saturated Ag/AgCl reference electrode of a double junction type.

After 6.5 minutes the flow of aqueous Solution C was stopped and aqueous Solution D was added over a period of 18.5 minutes. The millivolt was now controlled by variations in Solution D at 120±2 mv.

Subsequently, the water-soluble salt was removed from the mixture by an ordinary aggregation method, and then gelatin and caustic were added to the desalted emulsion to thereby prepare a silver chlorobromide emulsion which contains overall 94.5% Cl and 5.5% Br and whose mean particle size is 0.09 micron.

This emulsion, after adding 30 mls per mole of silver halide of a millimolar solution of thiourea dioxide thereto, was ripened at 60° C. for 60 minutes, and then, after adding 15 mls per mole of silver halide of a millimolar solution of $NaAuCl_4$ thereto, was again ripened at 60° C. until the maximum characteristics were obtained, thereby fogging the emulsion.

To this fogged emulsion, additional unactivated gelatin was added to obtain a suitable concentration for coating, 0.5 g/mole Ag of a substituted malononitrile filter dye was added to attain the desired speed and 25 mls/mole Ag of a 1M KCl solution was added to improve the re-reversal and formaldehyde was added as the hardening agent.

The mixture was applied to a subbed poly(ethylene terephthalate) film base with an appropriate topcoat to give a silver deposit of 2.3 g $Ag/m^2$ and a gelatin deposit of 2.4 $g/m^2$.

The coatings were then sensitometrically exposed and processed as described in Example 1. Results of sensitometry and re-reversal are shown in Tables 1 and 2.

TABLE 1

Sensitometric Characteristics of Film Described by this Invention

| | Example 1 | Example 2 |
|---|---|---|
| Dmin | .04 | .04 |
| Dmax | 5.6 | 5.6 |
| Speed | −3.21 | −3.24 |
| Toe Contrast | 1.63 | 1.85 |
| Shoulder Contrast | 10.0 | 11.73 |

Both Examples 1 and 2 are examples of fine grain (<100 nm) high chloride (≧80%) direct positive emulsions which demonstrate high Dmax, high contrast and low Dmin. Heretofore no one has been able to demonstrate the above outstanding results.

TABLE 2

Re-reversal Characteristics of Films Described by this Invention

| | Example 1 | Example 2 | 100% $Br^-$ Commercial Product A | 100% $Br^-$ Commercial Product B |
|---|---|---|---|---|
| Dmin | .04 | .04 | .04 | .04 |
| Dmin at 0.6 Log E over exposure | .04 | .05 | .05 | .05 |
| Dmin at 1.2 Log E over exposure | .04 | .10 | .06 | .08 |

This table demonstrates the outstanding re-reversal characteristics of our invention. For comparison two commercial products are shown which are 100% $Br^-$. The point to be taken here is that even 100% $Br^-$ emulsions of the daylight handleable type have some re-reversal characteristics. The fact that we have demonstrated similar re-reversal for high chloride systems is another key point of our invention.

What is claimed is:

1. A direct-positive silver halide emulsion comprising fine grain reduction and gold surface fogged silver halide grains having average diameters of less than 100 nm said silver halide grains containing an internal electron-trapping effective amount of at least one Group VIII metal dopant added during grain formation, at least 75% by weight of all silver halide grains in said emulsion being silver halide grains wherein at least 80 mole percent of the halide within said grains is chloride.

2. The emulsion of claim 1 wherein the metal dopant is present as $10^{-4}$ to $10^{-3}$ mole dopant per mole of silver.

3. The emulsion of claim 1 wherein the average diameter of silver halide grain is 80 nm or less.

4. The emulsion of claim 1 wherein less than 1.5 g of surface electron-accepting compounds per mole of silver halide is present in said emulsion.

5. The emulsion of claim 2 wherein less than 1.5 g of surface electron-accepting compounds per mole of silver halide is present in said emulsion and said Group VIII metal comprises rhodium, ruthenium, and mixtures thereof.

6. The emulsion of claim 3 wherein less than 1.5 g of surface electron-accepting compounds per mole of silver halide is present in said emulsion.

7. The emulsion of claim 2 wherein said emulsion has less than 0.15 g of electron-accepting compounds per mole of silver halide.

8. The emulsion of claim 2 wherein said emulsion has less than 0.001 moles of organic growth restrainers per mole of the silver halide.

9. The emulsion of claim 4 wherein said emulsion has less than 0.001 moles of organic growth restrainers per mole of the silver halide.

10. The emulsion of claim 7 wherein said emulsion has less than 0.001 moles of organic growth restrainers per mole of the silver halide.

11. The emulsion of claim 2 wherein said at least 75% of said silver halide grains have an overall concentration of greater than 80% chloride and comprise core-shell grains with lower chloride content in the core than in the shell and said metal dopant being present within said core.

12. The emulsion of claim 8 wherein said at least 75% of said silver halide grains have an overall concentration of greater than 80% chloride and comprise core-shell grains with lower chloride content in the core than in the shell.

13. The emulsion of claim 1 wherein at least 85% of all silver halide grains are silver halide grains with at least 80 molar percent chloride.

14. The emulsion of claim 2 wherein at least 85% of all silver halide grains are silver halide grains with at least 80 molar percent chloride.

15. The emulsion of claim 5 wherein at least 85% of all silver halide grains are silver halide grains with at least 80 molar percent chloride.

16. The emulsion of claim 10 wherein at least 85% of all silver halide grains are silver halide grains with at least 80 molar percent chloride.

17. The emulsion of claim 1 wherein at least 95% of all silver halide grains are silver halide grains with at least 80 molar percent chloride.

18. The emulsion of claim 2 wherein at least 95% of all silver halide grains are silver halide grains with at least 80 molar percent chloride.

19. The emulsion of claim 5 wherein at least 95% of all silver halide grains are silver halide grains with at least 80 molar percent chloride.

20. The emulsion of claim 10 wherein at least 95% of all silver halide grains are silver halide grains with at least 80 molar percent chloride.

21. The emulsion of claim 1 wherein a Group VIII metal can be distributed in any fashion between the core and the shell(s).

* * * * *